US005342531A

United States Patent [19]

Walters et al.

[11] Patent Number: 5,342,531

[45] Date of Patent: Aug. 30, 1994

[54] POLYALKYLENE GLYCOL LUBRICANT COMPOSITIONS

[75] Inventors: David K. Walters, Camberley; Rodney I. Barber, Bracknell, both of England

[73] Assignee: Ethyl Petroleum Additives Limited, Bracknell, England

[21] Appl. No.: 67,593

[22] Filed: May 27, 1993

Related U.S. Application Data

[63] Continuation of Ser. No. 707,098, May 29, 1991, abandoned.

[51] Int. Cl.[5] ..... C10M 169/04

[52] U.S. Cl. ..... 252/32.5; 252/32.7 E; 252/46.6; 252/52 A

[58] Field of Search ..... 252/32.7 E, 52 A, 32.5, 252/46.6

[56] References Cited

U.S. PATENT DOCUMENTS

| | | | |
|---|---|---|---|
| 2,447,288 | 8/1948 | Smith et al. | 260/461 |
| 3,652,411 | 3/1972 | Commichau | 252/34.7 |
| 4,459,215 | 7/1984 | Salentine | 252/32.5 |
| 4,582,943 | 4/1986 | Kristen et al. | 568/582 |
| 4,755,316 | 7/1988 | Magid et al. | 252/68 |

FOREIGN PATENT DOCUMENTS

| | | | |
|---|---|---|---|
| 0049133 | 4/1982 | European Pat. Off. | C08K 5/00 |
| 0378176 | 7/1990 | European Pat. Off. | C10M 111/04 |

*Primary Examiner*—Jacqueline V. Howard
*Attorney, Agent, or Firm*—John F. Sieberth

[57] ABSTRACT

A lubricant composition comprising a major proportion of polyalkylene glycol of lubricating viscosity and a minor proportion dissolved therein of (a) at least one sulphur-containing antiwear or extreme pressure agent, (b) at least one amine salt of at least one partially esterified monothiophosphoric acid, and (c) at least one amine salt of at least one partially esterified phosphoric acid. Such compositions have improved resistance to wear, oxidative degradation and metallic corrosion.

21 Claims, No Drawings

POLYALKYLENE GLYCOL LUBRICANT COMPOSITIONS

This application is a continuation of application Ser. No. 07/707,098, filed May 29, 1991, now abandoned.

This invention relates to lubricant compositions, and more particularly to gear lubricants based on polyalkylene glycols.

In order to employ polyalkylene glycols as the base oil for lubricants encountering metal-to-metal contact under conditions of load or pressure, such as gear lubricants, it is necessary to increase the wear resistance and improve the extreme pressure properties of such lubricants. Because of their polarity, polyalkylene glycols, especially water-soluble polyalkylene glycols, have relatively poor solvency characteristics for most conventional antiwear and extreme pressure additives. Moreover, because polyalkylene glycols tend to be hygroscopic, excessive corrosion of metal surfaces can result under actual service conditions because of the presence of water picked up by the polyalkylene glycol base oil.

An object of this invention is to provide an antiwear and extreme pressure additive system having adequate solubility in polyalkylene glycol based lubricants, including water-soluble polyalkylene glycols. A further object is to provide polyalkylene glycol gear lubricant compositions containing a performance-enhancing additive complement, particularly with respect to improved resistance to wear, oxidative degradation and metallic corrosion.

This invention involves the discovery, inter alia, that several components, hereinafter described, when used in combination, are sufficiently soluble in polyalkylene glycols, including water-soluble polyalkylene glycols, to confer good antiwear and extreme pressure properties on the lubricant. In another of its embodiments, this invention further provides an additive system which, when dissolved in a polyalkylene glycol lubricant base stock, yields a lubricant having improved resistance to wear, oxidative degradation and metallic corrosion. These and other aspects and features of this invention will be apparent from the ensuing description and appended claims.

In one of its embodiments this invention provides a lubricant composition comprising a major proportion of polyalkylene glycol of lubricating viscosity and a minor proportion dissolved therein of (a) at least one sulphur-containing antiwear or extreme pressure agent, (b) at least one amine salt of at least one partially esterified monothiophosphoric acid, and (c) at least one amine salt of at least one partially esterified phosphoric acid. Preferably this composition further includes a sterically hindered phenolic and/or amine antioxidant dissolved therein. Additionally it is particularly preferred to include in the foregoing lubricant compositions one or a mixture of corrosion inhibitors, particularly those of types described hereinafter.

Sulphur-containing Antiwear or Extreme Pressure Agent

Component (a) of the compositions of this invention is preferably one or a mixture of dihydrocarbyl polysulphides, such as the dialkyl polysulphides, the diaralkyl polysulphides, the diaryl polysulphides, the dicycloalkyl polysulphides, the dialkenyl polysulphides, and like compounds. Such compounds are exemplified by dinonyl trisulphide, diamyltetrasulphide, dibenzyltrisulphide, di-tert-butyltrisulphide, di-tert-butyltetrasulphide and di-tert-butyl pentasulphide. Use of dialkyl polysulphides is especially preferred, particularly where the dialkyl polysulphides are di-tert-alkyl polysulphides and are composed predominantly of di-tert-alkyl trisulphide.

Other compounds which may be used either separately or in combination with dihydrocarbyl polysulphides include sulphurised olefins, sulphurised fatty esters, sulphurised oils, sulphurised fatty acids, alkenyl monosulphides, and mixtures of such materials.

The prime requirement of the sulphur-containing extreme pressure or antiwear agent is that it have sufficient solubility in the polyalkylene glycol to remain dissolved therein at the concentration selected for use, usually between 0.01 and 2.0% by weight, and preferably from 0.02 to 0.4% by weight, based on the total weight of the solution.

Amine Salt of Partially Esterified Monothiophosphoric Acid

Component (b) of the compositions of this invention is a salt or adduct between one or a combination of amines and one or a combination of partially esterified monothiophosphoric acids. The amine may be one or more monoamines, one or more polyamines or a mixture of one or more monoamines with one or more polyamines. The amines may be primary, secondary and/or tertiary amines. The hydrocarbyl portion or portions in the molecule can be aliphatic, cycloaliphatic, aromatic and/or heterocyclic. In this connection, as used in this specification the term "hydrocarbyl" includes not only organic groups composed solely of carbon and hydrogen atoms, but additionally organic groups which contain, include or carry other functionality such as one or more oxygen atoms, one or more sulphur atoms and one or more nitrogen atoms, provided such functionality does not materially alter the fundamental hydrocarbonaceous character of the organic group. Thus the cyclic and acyclic hydrocarbyl groups may contain one or more oxygen, sulphur and/or nitrogen atoms in the ring and/or chain, and/or one or more oxygen-, sulphur-and/or nitrogen-containing substituent groups on the ring and/or chain, provided the overall group retains its hydrocarbonaceous character. Preferably the organic group contains no more than 20% by weight, most preferably 10% or less, of atoms other than carbon and hydrogen.

The preferred amines are aliphatic primary monoamines, particularly those containing 6 to 100, preferably 6 to 50, and most preferably 8 to 36 carbon atoms in an alkyl, alkenyl or polyethylenically unsaturated aliphatic group. These are exemplified by hexylamine, octylamine, nonylamine, decylamine, dodecylamine, cocoamine, soyamine, oleylamine, stearylamine, eicosylamine and like compounds including branched chain compounds such as commercially available mixtures of $C_{12}$ to $C_{14}$ tertiary alkyl primary amines, e.g., mixtures available under the designations Primene® 81R and Primene® JMT, among others. Mixtures of different types of monoamines can also be used in forming the salts or adducts, such mixtures being exemplified by a mixture of octylamine and dodecenylamine, a mixture of octylamine and oleylamine, and a mixture of tetrapropenylamine, $C_{14}$ tertiary alkyl primary amine and N-(dimethylcyclohexyl)amine.

The preferred amine salts of component (b) can be represented by the general formulas:

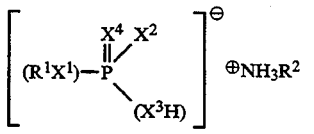

(I)

or

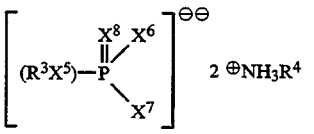

(II)

or

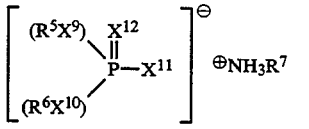

(III)

or mixtures thereof. In Formulas I, II and III, each of $R^1$, $R^2$, $R^3$, $R^4$, $R^5$, $R^6$, and $R^7$ is independently, a hydrocarbyl group, preferably an acyclic hydrocarbyl group and each of $X^1$, $X^2$, $X^3$, $X^4$, $X^5$, $X^6$, $X^7$, $X^8$, $X^9$, $X^{10}$, $X^{11}$, and $X^{12}$ is, independently, an oxygen atom or a sulphur atom, provided that only one of $X^1$, $X^2$, $X^3$ and $X^4$, only one of $X^5$, $X^6$, $X^7$ and $X^8$, and only one of $X^9$, $X^{10}$, $X^{11}$ and $X^{12}$ is a sulphur atom. Compounds of Formulas II and III are preferred.

Typical examples of such salts include

Octylamine salt of O-monohexylthionophosphoric acid
Octylamine salt of O,O-dihexylthionophosphoric acid
Octylamine salt of S-monoheptylthiophosphoric acid
Octylamine salt of O-monoheptylthiophosphoric acid
Octylamine salt of O,S-diheptylthiophosphoric acid
Octylamine salt of O,O-diheptylthiophosphoric acid
Octylamine salt of O-monoheptylthionophosphoric acid
Octylamine salt of O,O-diheptylthionophosphoric acid
Octylamine salt of S-mono-2-ethylhexylthiophosphoric acid
Octylamine salt of O-mono-2-ethylhexylthiophosphoric acid
Octylamine salt of O,S-di-2-ethylhexylthiophosphoric acid
Octylamine salt of O,O-di-2-ethylhexylthiophosphoric acid
Octylamine salt of O-mono-2-ethylhexylthionophosphoric acid
Octylamine salt of O,O-di-2-ethylhexylthionophosphoric acid
Octylamine salt of O,O-didecylthiophosphoric acid
Octylamine salt of O-monodecylthionophosphoric acid
Octylamine salt of O,O-didecylthionophosphoric acid
Octylamine salt of S-monododecylthiophosphoric acid
Octylamine salt of O-monododecylthiophosphoric acid
Octylamine salt of O,S-didodecylthiophosphoric acid
Octylamine salt of O,O-didodecylthiophosphoric acid
Octylamine salt of O-monododecylthionophosphoric acid
Octylamine salt of O,O-didodecylthionophosphoric acid In addition to the octylamine salts or adducts given above for purposes of illustration, use can be made of the corresponding nonylamine, decylamine, undecylamine, dodecylamine, tridecylamine, tetradecylamine, pentadecylamine, hexadecylamine, heptadecylamine, octadecylamine, oleylamine, cocoamine, soyamine, $C_{10-12}$ tertiary alkyl primary amine, and $C_{12-14}$ tertiary alkyl primary amine salts or adducts of the above and similar partially esterified acids of pentavalent phosphorus, including mixtures of any such compounds.

Amine Salt of Partially Esterified Phosphoric Acid

Component (c) is an amine salt of a partial ester of orthophosphoric acid. Such partial esters can be represented by the general formulas:

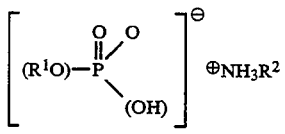

(IV)

or

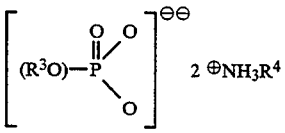

(V)

or

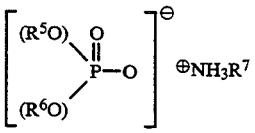

(VI)

or mixtures thereof. In Formulas IV, V and VI, each $R^1$, $R^2$, $R^3$, $R^4$, $R^5$, $R^6$, and $R^7$ is, independently, a hydrocarbyl group, preferably an acyclic hydrocarbyl group. Compounds of Formulas V and VI are preferred.

The amines used in forming such salts or adducts can be of the same general types as used in forming component (b), and the same considerations discussed above with reference to component (b) apply equally well with respect to component (c).

Illustrative examples of such salts include

Octylamine salt of O-monobutylphosphoric acid
Octylamine salt of O,O-dibutylphosphoric acid
Octylamine salt of O-monoamylphosphoric acid
Octylamine salt of O,O-diamylphosphoric acid
Octylamine salt of O-monohexylphosphoric acid
Octylamine salt of O,O-dihexylphosphoric acid
Octylamine salt of O-monoheptylphosphoric acid
Octylamine salt of O,O-diheptylphosphoric acid
Octylamine salt of O-monooctylphosphoric acid
Octylamine salt of O,O-dioctylphosphoric acid
Octylamine salt of O-mono-2-ethylhexyl-phosphoric acid
Octylamine salt of O,O-di-2-ethylhexyl-phosphoric acid
Octylamine salt of O-monododecylphosphoric acid
Octylamine salt of O,O-didodecylphosphoric acid
Octylamine salt of O-monooctadecylphosphoric acid
Octylamine salt of O,O-dioctadecylphosphoric acid As in component (b), the amine of component (c) can be any primary amine, such as those identified in connection with component (b).

The relative proportions among components (a), (b) and (c) can be varied within relatively wide ranges. Preferably however the weight ratio of (a):(b):(c) is within the ranges of 0.25–15:0.005–5:1, and more preferably within the range of 0.5–7:0.1–3:1. Ordinarily the polyalkylene glycol will contain a total of from 0.02 to 3% of components (a)+(b)+(c). Most preferably this total is in the range of 0.03 to 0.75%.

Polyalkylene Glycol

The lubricating oil base stocks used in formulating the lubricants of this invention are composed primarily or exclusively of polyalkylene glycols of lubricating viscosity. A wide variety of such oleaginous liquids are available as articles of commerce. Normally the polyalkylene glycol used will have a viscosity at 40° C. within the range of 20 to 10,000 centistokes and a viscosity within the range of 3 to 2,000 centistokes at 100° C.

Polyalkylene glycols which are used in accordance with this invention include the reaction product of a 1,2-oxide (vicinal epoxide) with water, or an alcohol, or an aliphatic polyhydric alcohol containing from 2 about 6 hydroxyl groups and between about 2 and about 8 carbon atoms per molecule. Suitable compounds useful in preparing these polyalkylene glycols include lower alkylene oxides containing between about 2 and about 8 carbon atoms, such as ethylene oxide, propylene oxide, butylene oxide, cyclohexene oxide, and glycidol. Mixtures of these 1,2-oxides are also useful in preparing polyalkylene glycols. The polyalkylene glycol may be formed by known techniques in which an aliphatic polyhydric alcohol or water or monohydric alcohol (often called an "initiator") is reacted with a single 1,2-oxide or a mixture of two or more of the 1,2-oxides. If desired, the initiator may be first oxyalkylated with one 1,2-oxide, followed by oxyalkylation with a different 1,2-oxide or a mixture of 1,2-oxides. If desired, the resulting oxyalkylated initiator then can be further oxyalkylated with a still different 1,2-oxide.

For convenience, the term "mixture," when applied to a polyalkylene glycol containing a mixture of 1,2-oxides, is intended to include both random and/or block polyethers such as:

(1) Random addition obtained by simultaneously reacting two or more 1,2-oxides with the initiator.

(2) Block addition in which the initiator is first reacted with one 1,2-oxide and then reacted with a second 1,2-oxide.

(3) Block addition (2) followed by random addition (1) or an additional block of 1,2-oxide.

Any suitable ratio of different 1,2-oxides may be employed. When a mixture of ethylene oxide and propylene oxide is utilised to form polyethers by random and/or block addition, the proportion of ethylene oxide is generally between about 3 and about 60, and preferably between about 5 and about 50 weight percent of the mixture.

Aliphatic polyhydric alcohol reactants in the polyalkylene glycol are those containing between 2 and about 6 hydroxyl groups and between 2 and about 8 carbon atoms per molecule, as illustrated by compounds such as the following: ethylene glycol, propylene glycol, 2,3-butylene glycol, 1,3-butylene glycol, 1,5-pentane diol, 1,6-hexene diol, glycerol, trimethylolpropane, sorbitol, pentaerythritol, mixtures thereof and the like. In addition, cyclic aliphatic polyhydric compounds such as starch, glucose, sucrose, methyl glucoside and the like may also be employed in the preparation of the polyalkylene glycol. Each of the aforesaid polyhydric compounds and alcohols can be oxyalkylated with ethylene oxide, propylene oxide, butylene oxide, cyclohexene oxide, glycidol, or mixtures thereof. For example, glycerol is first oxyalkylated with propylene oxide and the resulting polyalkylene glycol is then oxyalkylated with ethylene oxide. Alternatively, glycerol is reacted with ethylene oxide and the resulting polyalkylene glycol is reacted with propylene oxide and ethylene oxide. Each of the above-mentioned polyhydric compounds can be reacted with mixtures of ethylene oxide and propylene oxide or any two or more of any of the aforesaid 1,2-oxides, in the same manner. Techniques for preparing suitable polyethers from mixed 1,2-oxides are shown in U.S. Pat. Nos. 2,674,619; 2,733,272; 2,831,034, 2,948,575, and 3,036,118.

Monohydric alcohols used as initiators include the lower acyclic alcohols such as methanol, ethanol, propanol, butanol, pentanol, hexanol, neopentanol, isobutanol, decanol, and the like. As noted above, water can also be used as an initiator.

Preferred for use in this invention are the polyalkylene glycols produced by the polymerisation of ethylene oxide and propylene oxide onto an initiator.

The lubricant base oil may contain minor amounts of other types of lubricating oils, such as vegetable oils, mineral oils, and synthetic lubricants such as polyesters, alkylaromatics, polyethers, hydrogenated or unhydrogenated poly-α-olefins and similar substances of lubricating viscosity.

Sterically Hindered Phenolic Antioxidant

In the preferred embodiments of this invention the lubricant composition or additive concentrate also contains at least one sterically hindered phenolic antioxidant. These include ortho-alkylated phenolic compounds such as 2,6-di-tert-butylphenol, 4-methyl-2,6-di-tert-butylphenol, 2,4,6-tri-tert-butylphenol, 2-tert-butylphenol, 2,6-di-isopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-di-styryl-4-nonylphenol, and their analogs and homologs. Mixtures of two or more such mononuclear phenolic compounds are also suitable.

The preferred antioxidants for use in the compositions of this invention are methylene bridged alkylphenols, and these can be used singly or in combinations with each other, or in combinations with sterically-hindered unbridged phenolic compounds. Illustrative methylene bridged compounds include 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylenebis(2,6-di-tert-butylphenol), and similar compounds. Particularly preferred are mixtures of methylene-bridged alkylphenols such as are described in U.S. Pat. No. 3,211,652.

Amine antioxidants, especially oil-soluble aromatic secondary amines can also be used in the compositions of this invention. Whilst aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-α-naphthylamine, phenyl-β-naphthylamine, alkyl- or aralkyl-substituted phenyl-α-naphthylamine containing 1 or 2 alkyl or aralkyl groups each having up to about 16 carbon atoms, alkyl- or aralkyl-substituted phenyl-β-naphthylamine containing 1 or 2 alkyl or aralkyl groups each having up to about 16 carbon atoms, and similar compounds.

A preferred type of aromatic amine antioxidant is an alkylated diphenylamine of the general formula

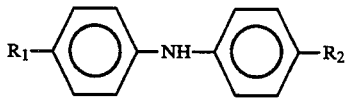

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominantly a 4,4'-dinonyldiphenylamine (i.e., bis(4-nonylphenyl)amine) wherein the nonyl groups are branched.

An antioxidant composed of a combination of (i) an oil soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl)amine wherein the alkyl group is a branched alkyl group having 8 to 12 carbon atoms, the proportions of (i) , (ii) and (iii) on a weight basis falling in the range of 3.5 to 5.0 parts of component (i) and 0.9 to 1.2 parts of component (ii) per part by weight of component (iii) may be used.

The lubricating compositions of this invention preferably contain 0.01 to 1.0% by weight, more preferably 0.05 to 0.7% by weight, of one or more sterically hindered phenolic antioxidants of the types described above. Alternatively or additionally the lubricants of this invention may contain 0.01 to 1.0% by weight, more preferably 0.05 to 0.7% by weight of one or more aromatic amine antioxidants of the types described above.

Corrosion Inhibitors and Metal Deactivators

It is also preferred pursuant to this invention to employ in the lubricant compositions and additive concentrates a suitable quantity of a corrosion inhibitor and/or a metal deactivator. This may be a single compound or a mixture of compounds having the property of inhibiting corrosion of metallic surfaces.

Among suitable corrosion inhibitors and/or metal deactivators for use in accordance with preferred embodiments of this invention are the thiadiazoles and triazoles such as tolyltriazole; dimer and trimer acids such as are produced from tall oil fatty acids, oleic acid, linoleic acid, etc.; alkenyl succinic acid and alkenyl succinic anhydride corrosion inhibitors such as tetrapropenylsuccinic acid, tetrapropenylsuccinic anhydride, dodecenylsuccinic acid, dodecenylsuccinic anhydride, hexadecenylsuccinic acid, and similar compounds; and half esters of alkenyl succinic acids having 8 to 24 carbon atoms in the alkenyl group with alcohols such as diols and polyglycols. Also useful are aminosuccinic acids or derivatives thereof represented by the formula:

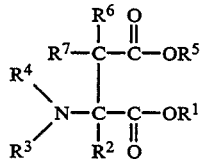

wherein each of $R^1$, $R^2$, $R^5$, $R^6$ and $R^7$ is independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms. The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred of the aminosuccinic acid derivative is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

The lubricant compositions of this invention preferably contain from 0.005 to 0.5% by weight, more preferably from 0.01 to 0.2% by weight, of one or more corrosion inhibitors and/or metal deactivators of the type described above.

Other Components

For best results, the compositions of this invention will usually contain small amounts of a demulsifier, an antifoam agent and one or more inert diluents. Among suitable demulsifiers are organic sulphonates and oxyalkylated phenolic resins. Suitable antifoam agents include silicones and organic polymers such as acrylate polymers. Various antifoam agents are described in *Foam Control Agents* by H. T. Kerner (Noyes Data Corporation, 1976, pages 125–176). The diluents which may be used include hydrocarbons, alcohols and esters of suitable viscosity which are compatible with the base lubricating oil and the additive components being utilised in the practise of this invention. The preferred diluents are mineral oils having a viscosity at 100° C. in the range of 2 to 40 centistokes.

A further embodiment of this invention involves the provision of an additive concentrate comprising, on a weight basis, and preferably a minor amount of inert diluent and a major amount of the following components in the weight proportions specified:

a) 5 to 70% of at least one sulphur-containing antiwear or extreme pressure agent;

b) 1 to 30% of at least one amine salt of at least one partially esterified monothiophosphoric acid;
c) 1 to 30% of at least one amine salt of at least one partially esterified phosphoric acid;
d) 2 to 50%, and preferably 10 to 40%, of at least one sterically hindered phenolic antioxidant composed principally or entirely of one or more methylene bridged alkylphenols;
e) 0 to 50%, and preferably 10 to 40%, of at least one aromatic amine antioxidant, especially a bis(alkylphenyl)amine wherein the alkyl groups have 8 to 12 carbon atoms;
f) 0 to 15%, and preferably 2.5 to 8%, of at least one corrosion inhibitor and/or metal deactivator, especially an aminosuccinic acid or derivative thereof of the formula depicted hereinabove.

The foregoing additive concentrates are useful in oils of lubricating viscosity other than polyalkylene glycol oils.

The lubricant compositions and additive concentrates described above are especially useful as industrial gear lubricants for use with various gear systems, such as worm gears. While still other ingredients can be present in such compositions and concentrates, other ingredients are ordinarily unnecessary for such industrial gear applications. When used as functional fluids such as hydraulic fluids that come in contact with various elastomer seals such as silicone rubbers and fluoroelastomers, the above compositions are of particular advantage inasmuch as they can contain little, if any, free—i.e., uncomplexed—basic nitrogen components, materials which are known to exert adverse effects upon such rubbers and elastomers.

The following Examples, in which all parts are by weight, illustrate but are not intended to limit this invention.

EXAMPLE 1

Dissolved in a polyalkylene glycol produced by the polymerisation of ethylene oxide and propylene oxide onto at least one initiator molecule (Emkarox VG-222; Imperial Chemical Industries) having a viscosity at 40° C. of 220 centistokes are:

1.0% of dialkylpolysulphide
0.13% of $C_{12-14}$ tertiary alkyl primary amine salt of dibutylthiophosphoric acid
0.11% of oleylamine salt of dibutylthiophosphoric acid
0.27% of oleylamine salt of amyl acid phosphate
0.002% of acrylate antifoam agent as a concentrate containing 60% of kerosene.

EXAMPLE 2

The procedure of Example 1 is repeated using a polypropylene glycol having a viscosity at 40° C. of 277 centistokes.

EXAMPLE 3

Dissolved in the respective compositions of Examples 1 and 2 is in one case 0.03% of tetrapropenylsuccinic acid, in another case 0.05% of tetrapropenylsuccinic anhydride and in still another case 0.035% of a half ester of tetrapropenylsuccinic acid and propanediol.

EXAMPLE 4

Dissolved in the respective compositions of Examples 1–3 in one case is 0.2% of 4,4'-methylenebis(2,6-di-tert-butylphenol and in another case 0.2% of 2,2'-methylenebis(2,4-di-tert-butylphenol).

EXAMPLE 5

Dissolved in the respective compositions of Examples 1–3 is 0.2% of a mixture composed of approximately 80% methylene bridged polyalkyl phenols, 15% unbridged alkylated phenols and 5% solvents ("ETHYL" Antioxidant 728; Ethyl Corporation).

EXAMPLE 6

Dissolved in a polyalkylene glycol produced by the polymerisation of ethylene oxide and propylene oxide onto at least one initiator molecule (Emkarox VG-127W; Imperial Chemical Industries) having a typical viscosity at 40° C. of 127 centistokes are:

0.11% of dialkylpolysulphide
0.015% of $C_{12-14}$ tertiary alkyl primary amine salt of dibutylthiophosphoric acid
0.012% of oleylamine salt of dibutylthiophosphoric acid
0.031% of oleylamine salt of amyl acid phosphate
0.0002% of acrylate antifoam agent as a concentrate containing 60% of kerosene.

EXAMPLE 7

The procedure of Example 6 is repeated using a polyalkylene glycol produced by the polymerisation of ethylene oxide and propylene oxide onto at least one initiator molecule (Emkarox VG-132W; Imperial Chemical Industries) having a typical viscosity at 40° C. of 132.

EXAMPLE 8

Dissolved in the respective compositions of Examples 6 and 7 is in one case 0.03% of tetrapropenylsuccinic acid, in another case 0.05% tetrapropenyl succinic anhydride and in still another case 0.035% of a half ester of tetrapropenylsuccinic acid and propanediol.

EXAMPLE 9

Dissolved in the respective compositions of Examples 6–8 is 0.2% of 4,4'-methylenebis(2,6-di-tertbutylphenol) and in another case 0.2% of 4,4'-methylenebis(2-tert-butyl-o-cresol).

EXAMPLE 10

Dissolved in the respective compositions of Examples 6–8 is 0.2% of a mixture composed of approximately 85% methylene bridged phenols, 12–13% unbridged alkylphenols and 3–2% solvent.

EXAMPLE 11

The procedure of Example 6 is repeated using water-soluble polyalkylene glycols of the type described therein but having, respectively, typical viscosities at 40° C. of 32.5 cSt, 680 cSt, and 1050 cSt.

EXAMPLE 12

The procedures of Examples 6–10 are repeated except that an oleylamine salt of bis(2-ethylhexyl) phosphoric acid is used in lieu of oleylamine salt of amyl acid phosphate.

EXAMPLE 13

The procedures of Examples 6–10 are repeated except that soyamine salts of an approximately equimolar mixture of amyl and hexyl acid phosphates are used in lieu of oleylamine salt of amyl acid phosphate.

EXAMPLE 14

The procedures of Examples 12 and 13 are repeated except that in one case, 0.01% of oleylamine salt of diamylthiophosphoric acid and that in another case, 0.01% of octylamine salt of di-2-ethylhexylthiophosphoric acid are used instead of $C_{12-14}$ tertiary alkyl primary amine salt of dibutylthiophosphoric acid.

EXAMPLE 15

The procedures of Examples 8–10 are applied to the compositions of Examples 11–14.

EXAMPLE 16

Dissolved in the respective compositions of Examples 6–8 are 0.2% of 4,4'-methylenebis(2,6-di-tertbutylphenol) and 0.2% of bis(4-nonylphenyl)amine (Naugalube 438L).

EXAMPLE 17

Dissolved in the respective compositions of Examples 6–8 are 0.2% of a mixture composed of approximately 85% methylene-bridged phenols, 12–13% unbridged alkylphenols and 3–2% solvent, and additionally, 0.2% of bis(4-nonylphenyl)amine.

EXAMPLE 18

The procedures of Examples 16 and 17 are repeated except that oleylamine salt of bis(2-ethylhexyl)phosphoric acid is used in lieu of oleylamine salt of amyl acid phosphate.

EXAMPLE 19

The procedures of Examples 16 and 17 are repeated except that soyamine salts of an approximately equimolar mixture of amyl and hexyl acid phosphates are used in lieu of oleylamine salt of amyl acid phosphate.

EXAMPLE 20

The procedures of Examples 18 and 19 are repeated except that in one case, 0.01% of oleylamine salt of diamylthiophosphoric acid and that in another case, 0.01% of octylamine salt of di-2-ethylhexylthiophosphoric acid are used instead of $C_{12-14}$ tertiary alkyl primary amine salt of dibutylthiophosphoric acid.

The efficacy of this invention is illustrated by the property characteristics of the composition of Example 7 with which had been additionally blended 0.035% of a half ester of tetrapropenylsuccinic acid and propanediol, 0.2% of the antioxidant mixture of Example 10, 0.2% of bis(nonylphenyl)amine, and 0.06% of metal deactivator. This composition was tested against the David Brown Gear Industries Ltd. specification number S1.53.105 for Type "G" Grade 4 synthetic lubricating oils for use in industrial enclosed gear units; this specification covers the requirements of synthetic lubricants based on polyglycols.

This composition was found to comply with the Specification requirements for load carrying capacity (IP 334 test), copper corrosion (ASTM D130), rust prevention (IP 135, procedure A), oxidation stability (ASTM D2893), foaming tendency (ASTM D892), and air release (IP 313).

The same composition was also tested by the TOST oxidation test (ASTM D943). The total acid number after 3,076 hours was 1.12 mg KOH per gram.

Similarly, the composition of Example 1 was evaluated for load carrying characteristics. It was found to have a Timken Load Arm OK Load of over 100 pounds (ASTM D2782), a load wear index of 86.7 kg and a weld point of 250 kg when tested in the four ball EP test (ASTM D2783).

A feature of this invention is the excellent compatibility and solubility of the products of this invention in polyalkylene glycol fluids of the type described hereinabove. By way of example, it was found that the addition of 0.2% by weight of a product of this invention to a polyalkylene glycol fluid yielded a solution which remained entirely clear after standing for 3 weeks under ambient temperature conditions. In contrast, the addition of the same quantity of a commercially available sulphur-phosphorus gear additive to another portion of the same polyalkylene glycol fluid yielded a product which contained precipitated deposits after standing for three weeks under the same ambient temperature conditions.

What is claimed is:

1. A lubricant composition comprising a major proportion of polyalkylene glycol of lubricating viscosity and a minor proportion, dissolved therein, of (a) at least one sulfur-containing antiwear or extreme pressure agent, and (b) the combination of the components, (i) at least one amine salt of at least one partially esterified monothiophosphoric acid, and (ii) at least one amine salt of at least one partially esterified phosphoric acid, said combination and its components being present in an amount sufficient to insure that the lubricant composition remains clear, at ambient temperature, for at least three weeks after its formation.

2. A composition as claimed in claim 1 further including a sterically hindered phenolic antioxidant dissolved therein.

3. A composition as claimed in claim 2 wherein the hindered phenolic antioxidant is composed principally or entirely of one or more methylene-bridged sterically hindered phenols.

4. A composition as claimed in claim 1 further including a corrosion inhibitor and/or metal deactivator dissolved therein.

5. A composition as claimed in claim 3 further including a corrosion inhibitor, and/or metal deactivator dissolved therein.

6. A composition as claimed in claim 1 wherein component (b) is composed principally or entirely of one or more monoaliphatic amine salts of one or more dialiphatic esters of one or more monothiophosphoric acids, and component (c) is composed principally or entirely of one or more aliphatic amine salts of one or more mono- and/or dialiphatic esters of phosphoric acid.

7. A composition as claimed in claim 2 wherein component (b) is composed principally or entirely of one or more monoaliphatic amine salts of one or more dialiphatic esters of one or more monothiophosphoric acids, and component (c) is composed principally or entirely of one or more aliphatic amine salts of one or more mono- and/or dialiphatic esters of phosphoric acid.

8. A composition as claimed in claim 3 wherein component (b) is composed principally or entirely of one or more monoaliphatic amine salts of one or more dialiphatic esters of one or more monothiophosphoric acids, and component (c) is composed principally or entirely of one or more aliphatic amine salts of one or more mono- and/or dialiphatic esters of phosphoric acid.

9. A composition as claimed in claim 4 wherein component (b) is composed principally or entirely of one or more monoaliphatic amine salts of one or more dialiphatic esters of one or more monothiophosphoric acids, and component (c) is composed principally or entirely of one or more aliphatic amine salts of one or more mono- and/or dialiphatic esters of phosphoric acid.

10. A composition as claimed in claim 1 wherein component (a) is composed principally or entirely of one or more dialkylpolysulphides.

11. A composition as claimed in claim 2 wherein component (a) is composed principally or entirely of one or more dialkylpolysulphides.

12. A composition as claimed in claim 3 wherein component (a) is composed principally or entirely of one or more dialkylpolysulphides.

13. A composition as claimed in claim 4 wherein component (a) is composed principally or entirely of one or more dialkylpolysulphides.

14. A composition as claimed in claim 5 wherein component (a) is composed principally or entirely of one or more dialkylpolysulphides.

15. A composition as claimed in claim 4 wherein the polyalkylene glycol is composed principally or entirely of polyalkylene glycol produced by the polymerisation of ethylene oxide and propylene oxide onto at least one initiator molecule.

16. A composition as claimed in claim 5 wherein the polyalkylene glycol is composed principally or entirely of polyalkylene glycol produced by the polymerisation of ethylene oxide and propylene oxide onto at least one initiator molecule.

17. A composition as claimed in claim 6 wherein the polyalkylene glycol is composed principally or entirely of polyalkylene glycol produced by the polymerisation of ethylene oxide and propylene oxide onto at least one initiator molecule.

18. A composition as claimed in claim 7 wherein the polyalkylene glycol has a water solubility at 20° C. of at least 10 grams per liter.

19. An additive concentrate comprising, on a weight basis, a minor amount of inert diluent and a major amount of the following components in the weight proportions specified:

a) 5 to 70% of at least one sulphur-containing antiwear or extreme pressure agent;

b) 5 to 30% of at least one amine salt of at least one partially esterified monothiophosphoric acid;

c) 1 to 30% of at least one amine salt of at least one partially esterified phosphoric acid;

d) 10 to 40% of at least one sterically hindered phenolic antioxidant composed principally or entirely of one or more methylene-bridged alkylphenols;

e) 10 to 40% of at least one aromatic amine antioxidant, and f) 0 to 15% of at least one corrosion inhibitor and/or metal deactivator.

20. A composition as claimed in claim 19 wherein component a) is composed principally or entirely of one or more dialkylpolysulphides; component b) is composed principally or entirely of one or more monoaliphatic amine salts of one or more dialiphatic esters of one or more monothiophosphoric acids; component c) is composed principally or entirely of one or more aliphatic amine salts of one or more mono- and/or dialiphatic esters of phosphoric acid; component d) is composed of a mixture of methylene bridged alkylphenols and unbridged alkylphenols in a weight ratio of from 5:1 to 7:1, both respectively; component e) is composed of at least one bis(alkylphenylamine wherein the alkyl groups have 8 to 12 carbon atoms; and component f) is composed of (i) at least one thiadiazole corrosion inhibitor or (ii) at least one triazole corrosion inhibitor and/or metal deactivator, or (iii) at least one hydrocarbyl succinic acid corrosion inhibitor and/or metal deactivator, or (iv) at least one half ester of a hydrocarbyl succinic acid and a polyol, or (v) at least one aminosuccinic acid or derivative thereof, or (vi) any combination of any two or more of (i), (ii), (iii), (iv) and (v).

21. A method for insuring that a lubricant composition, comprised of (i) polyalkylene glycol of lubricating viscosity, and (ii) a solublized minor amount of at least one sulfur-containing antiwear or extreme pressure agent remains clear, at ambient temperature, for at least three weeks after the formation of the lubricant composition, the method comprising, adding to the lubricant composition at least one amine salt of at least one partially esterified monothiophosphoric acid, and at least one amine salt of at least one partially esterified phosphoric acid in an amount sufficient to insure the before-recited clarity.

* * * * *